US005758957A

United States Patent [19]

Perrotin

[11] Patent Number: 5,758,957

[45] Date of Patent: Jun. 2, 1998

[54] LIGHTING UNIT FOR A VEHICLE, HAVING IMPROVED VENTILATING MEANS

[75] Inventor: Arnaud Perrotin, Paris, France

[73] Assignee: Valeo Vision, Bobigny Cedex, France

[21] Appl. No.: 716,578

[22] Filed: Sep. 19, 1996

[30] Foreign Application Priority Data

Sep. 19, 1995 [FR] France ..... 95 10957

[51] Int. Cl.[6] ..... F21V 29/00

[52] U.S. Cl. ..... 362/294; 362/80; 362/373

[58] Field of Search ..... 362/80, 96, 294, 362/345, 362, 373

[56] References Cited

U.S. PATENT DOCUMENTS 4,739,458 4/1988 Yomayoshi et al. .
5,010,453 4/1991 Ketterman .
5,367,438 11/1994 Deslandres ..... 362/373

FOREIGN PATENT DOCUMENTS 2 183 934 12/1973 France .
2 654 048 5/1991 France .
2 660 413 10/1991 France .
2 242 513 7/1993 United Kingdom .

*Primary Examiner*—Y. My Quach
*Attorney, Agent, or Firm*—Morgan & Finnegan, L.L.P.

[57] ABSTRACT

A lighting, indicating or signalling unit for a motor vehicle has a ventilating device defined partly on the housing of the unit and partly by a cover member which is mounted on the housing so that they together define a sinuous ventilation path to the interior of the housing. The sinuous ventilation path comprises:

in its lower part, a double air inlet comprising two inlet apertures facing each other, and an inlet passage substantially transverse to the general direction joining the inlet apertures;

a labyrinth extending substantially upwards from the double air inlet; and a passage for communication between the labyrinth and the interior of the housing, and at least partly defined between resilient mounting lugs by which the cover member is secured on the housing.

11 Claims, 1 Drawing Sheet

LIGHTING UNIT FOR A VEHICLE, HAVING IMPROVED VENTILATING MEANS

FIELD OF THE INVENTION

The present invention relates in general terms to apparatus for lighting, indicating or signalling purposes in a motor vehicle, and in particular to a lighting, indicating or signalling unit, for example a vehicle headlamp, having a ventilating device for ventilating the interior of the unit.

BACKGROUND OF THE INVENTION

A matter of constant concern in the design of such ventilating devices is to provide proper ventilation for the interior of the housing or body of the lighting, indicating or signalling unit, while at the same time preventing, to the most effective possible extent, penetration of water, dirt, dust and other contaminants into the interior of the unit.

Nowadays, this is becoming more and more difficult because it is necessary to prevent any penetration of water in the presence of a high pressure washing jet, especially when the latter is being used within the engine compartment of the vehicle in which the housings of headlamps, in particular, are exposed.

The current state of the art is reflected, in particular, in French patent specifications FR 2 654 048 A, FR 2 183 934 A and FR 2 660 413 A, and in U.S. Pat. No. 4,739,458. In particular, French patent specification FR 2 654 048 A discloses an arrangement in which a sinuous ventilation path is defined partly by the housing or body of the apparatus, and partly by a cover member which is carried on this housing or body.

DISCUSSION OF THE INVENTION

An object of the present invention is to propose an arrangement of this last mentioned kind, but with improved performance in all respects, and in particular when a high pressure water jet is being used, while at the same time continuing to ensure satisfactory ventilation.

A further object of the invention is to provide a ventilating device which is easy to fit, and which can, if desired, easily be fitted with a foam filter.

According to the invention, a lighting, indicating or signalling unit for a motor vehicle, including a ventilating device which consists of first ventilating means carried by a housing of the unit, in combination with second ventilating means carried by a cover member mounted on the housing, so as to define together a sinuous path to the interior of the unit, for ventilation of the latter, is characterised in that the ventilation path comprises:

- a double air inlet in a lower part of the ventilating device, the double air inlet comprising two inlet apertures in facing relationship with each other, together with an inlet passage which extends substantially transversely to the general direction defined from one said air inlet aperture to the other;
- a labyrinth which extends substantially upwardly from the double air inlet; and
- a passage of communication between the labyrinth and the interior of the unit, the passage being defined at least partially between lugs by which the cover member is fitted resiliently on the housing.

The inlet passage of the double air inlet preferably constitutes a lower portion of the labyrinth.

The communication passage preferably constitutes an upper portion of the labyrinth.

According to a preferred feature of the invention, the labyrinth comprises three portions which are defined by an intermediate baffle (110) and an intermediate wall of the first and second ventilating means respectively, the three labyrinth portions being disposed at different heights.

The unit preferably includes two said lugs, in the form of resilient mounting lugs defining between them a space which is open downwardly on to the labyrinth. With this arrangement, and where the labyrinth comprises three portions as defined above, the unit preferably also includes a foam filter which is retained between the lugs, in such a way as to overlie an adjacent intermediate baffle.

The mounting lugs preferably include hooking teeth which cooperate with the edges of a through aperture formed in the housing, the aperture being left partly open by the lugs, which extend through the aperture.

Further aspects, features and advantages of the present invention will appear more clearly on a reading of the following detailed description of one preferred embodiment of the invention, which is given by way of non-limiting example only and with reference to the accompanying drawings.

DESCRIPTION OF A PREFERRED EMBODIMENT OF THE INVENTION

Figure 1:
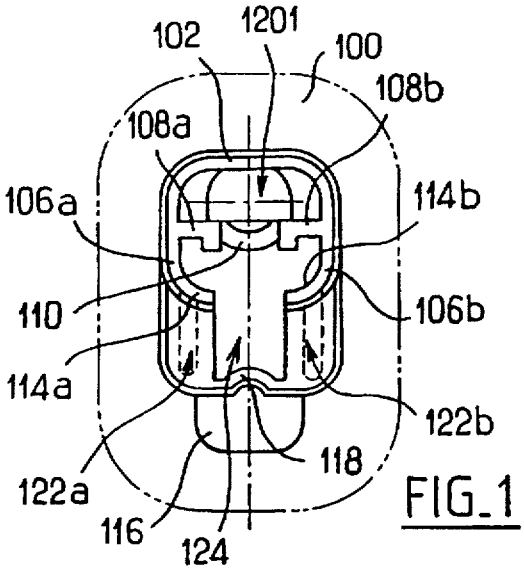
FIG. 1 is a rear elevation of part of a headlamp housing that comprises part of a ventilating device in accordance with the invention.

A headlamp has a hollow housing, most of which is not shown, but which has a wall, a portion of which is indicated by the reference numeral 100 in FIGS. 1, 2, 5 and 6. This wall may for example be the posterior wall of the housing, the interior of the housing being to the left of the wall 100 in FIGS. 2 and 6. The wall 100 carries a first ventilating means which consists essentially of a set of walls or wall portions (referred to herein as baffles), that project from the wall 100 so as to define a rectangular profile with rounded corners, as can be seen in FIG. 1.

Figure 2:
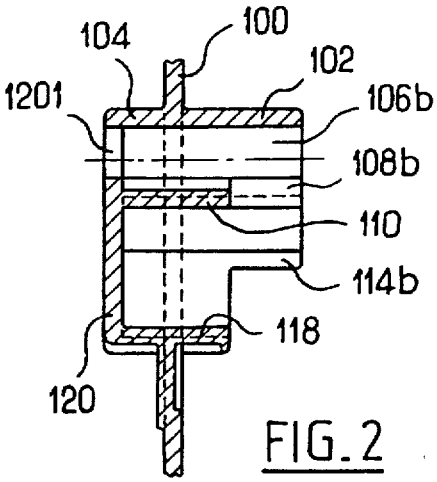
FIG. 2 is a side elevation, shown in transverse vertical cross section, of the same part of the headlamp housing as is shown in FIG. 1.

These baffles comprise:

- an outer top baffle 102 which is generally horizontal and which projects outwardly (i.e. towards the right in FIG. 2) over a first distance from the wall 100;
- an inner top baffle 104 which is a horizontal extension of the outer top baffle 102 and which projects into the interior of the headlamp housing (i.e. towards the left in FIG. 2);
- two vertical side baffles 106*a* and 106*b*, which project downwardly from the top baffles 102 and 104;

a generally horizontal intermediate baffle which extends between the side baffles 106*a* and 106*b*, and which comprises two edge portions 108*a* and 108*b* of generally L-shaped cross section, which extend over the whole length of the top baffles 102 and 104, and which are separated by a central portion 110 of the intermediate baffle, the portion 110 being shorter and terminating on the outer side behind the edge portions 108*a* and 108*b*;

a bottom baffle 118 which joins together the bottom ends of the vertical side baffles 106*a* and 106*b*, and which extends towards the outside, as seen in FIG. 2, by about the same amount as the central portion 110 of the intermediate baffle;

two re-entrant baffle elements 114*a* and 114*b*, the profile of which is substantially that of a quarter circle as shown in FIG. 1, and which extend inwardly towards each other from the side baffles 106 and below the edge portions 108*a* and 108*b* of the intermediate baffle;

an inner transverse or facial baffle 120 which extends between the inner edges of the top baffles 102, 104, the intermediate baffle 108*a*, 108*b*, 110, the bottom baffle 118, and the side baffles 106*a*, 106*b*, the inner transverse baffle 120 having a substantially semicircular through aperture 1201 in a location between the top baffle 104 and the edge portions 108*a*, 108*b* of the intermediate baffle; and two outer front or facial baffles 122*a* and 122*b*, which extend between the baffle elements 114*a*, 114*b* and the bottom baffle 118, so as to leave between these latter a central aperture 124, the width of which is predetermined.

These various elements, constituting the first ventilating means, are preferably formed by moulding integrally with the housing of which the wall 100 forms a part.

It will be understood that, although this housing has been referred to as a headlamp housing, these arrangements are, in general, equally applicable to the housing, or body, of any lighting, indicating or signalling unit for a motor vehicle.

The first ventilating means just described with reference to FIGS. 1 and 2 constitutes, with a cover member shown in FIGS. 3 and 4, a ventilating device for the lighting, indicating or signalling unit.

Figure 3:
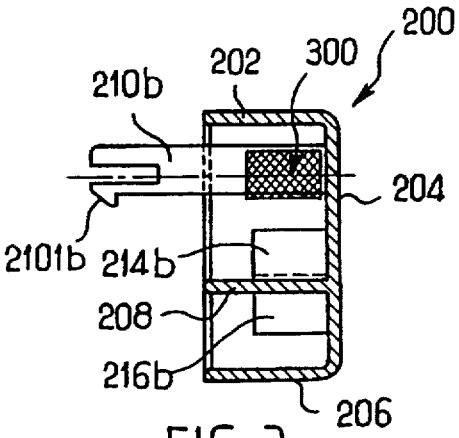
FIG. 3 is a front view of a cover member which is adapted to cooperate with the part of the housing shown in FIGS. 1 and 2.
Figure 4:
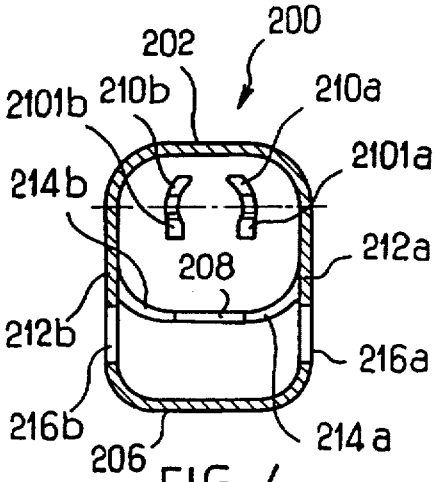
FIG. 4 shows the same cover member as FIG. 3, in vertical transverse cross section.

With reference to FIGS. 3 and 4, the cover member is indicated generally by the reference numeral 200, and constitutes a second ventilating means. The cover member 200 has a top wall 202, a bottom wall 206 and two side walls 212*a* and 212*b*. The internal contours of these walls correspond substantially with the external contours of the baffles 102, 118, 116*a* and 116*b* respectively.

The cover member 200 also has a transverse of facial wall 204 which joins together the walls 202, 206, 212*a* and 212*b*, and which is solid over its whole extent; and two flexible lugs 210*a* and 210*b*. The respective profiles of these lugs 210*a* and 210*b* are arcuate and concentric with each other, as seen in FIG. 4. Each of these lugs has at its free end a hooking tooth 2101*a*, 2101*b* respectively. Each of these teeth has a generally triangular profile projecting outwardly (see FIG. 3). It will be observed that the lugs 210*a* and 210*b* together define a generally cylindrical seating, in which a filter of elastic foam, indicated by the reference numeral 300 in FIG. 3, may optionally be fitted. Such a filter is preferably made of a reticulated polyurethane foam having about seven pores per square centimeter and a density of about 20 to 25 $kg/m^3$.

The cover member 200 further includes two wall elements 214*a* and 214*b*, each extending over a quarter of a circle (as shown in FIG. 4) and having a top surface which fits against the corresponding baffle elements 114*a* and 114*b* respectively of the housing. These wall elements 214*a*, 214*b* extend from the transverse wall 204, but over only part of the depth of the cover member 200, as can be seen in FIG. 3. They are joined together by a horizontal intermediate wall 208, which projects by a greater amount from the transverse wall 204, so that it has the same horizontal length as the top wall 202, the bottom wall 206 and the side walls 212*a*, 212*b*. It will be noticed that the width of the intermediate wall 208 is substantially equal to the horizontal width of the central aperture 124 in the housing (FIG. 1).

Finally, the cover member 200 has two air inlet apertures 216*a* and 216*b* which are formed, facing each other, in the side walls 212*a* and 212*b* respectively, below the wall elements 214*a* and 214*b*. The horizontal length of each of these apertures is approximately the same as that of the wall elements 214*a* and 214*b*.

The cover member 200 is fitted on the housing in the following way. First, if a foam filter 300 is to be used, this filter is fitted between the flexible lugs 210*a* and 210*b* and in engagement against the inner surface of the transverse wall 204, as shown in FIG. 3. The cover member 200 is then offered up, in horizontal straight line movement, to the ventilating means of the housing, so as to engage the top wall 202, bottom wall 206 and side walls 212*a* and 212*b* of the latter around the corresponding baffles 102, 118 etc. At the same time, the lugs 210*a* and 210*b* are engaged in the aperture 1201 of the housing. When the teeth 2101*a* and 2101*b* have passed the edges of the aperture 1201 (being deformed slightly upwardly in order to do this), they relax into hooking engagement on the inner transverse baffle 120 of the housing, so that the cover member 200 is now snap-fitted on the housing.

Figure 5:
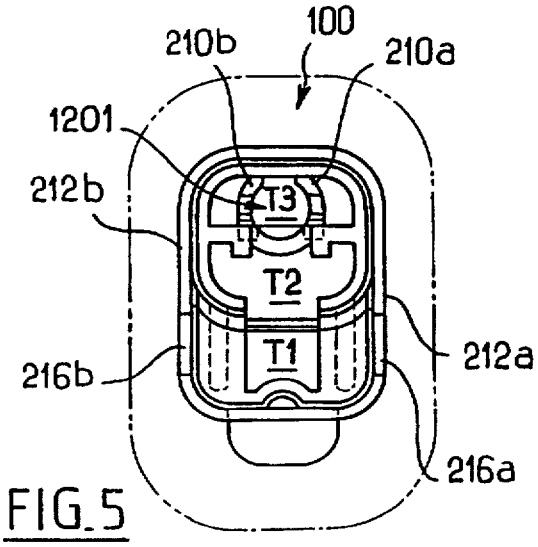
FIG. 5 is a view in front elevation of a ventilating device according to the invention, comprising the same part of the housing assembled with its cover member.
Figure 6:
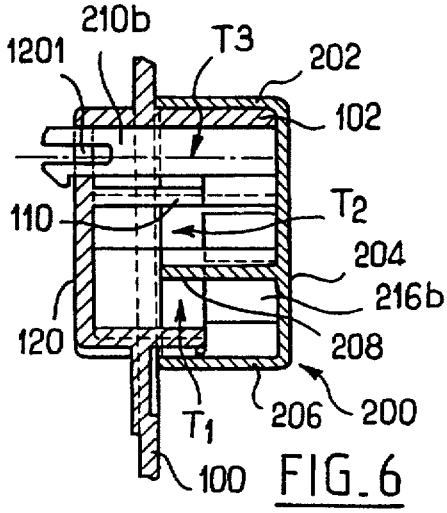
FIG. 6 shows the same device as FIG. 5, but in transverse vertical cross section.

Reference is now made to FIGS. 5 and 6, which show the ventilating device after this fitting operation has been carried out. It will be noted from FIG. 6 that the position of the cover member 200 with respect to the housing is defined by the abutment of the free edges of the walls 202 and 206 of the cover member on the housing wall 100.

The ventilating device itself now defines a sinuous ventilation path to the interior of the housing.

More particularly, in its lower region, the ventilating device comprises a flat, T-shaped double air inlet in communication with the outside. This inlet consists of the two apertures 216*a* and 216*b*, the space that exists between the intermediate wall 208 of the cover member and the bottom baffle 118 of the housing, and the throat between the outer transverse baffles 122*a* and 122*b* of the housing.

The ventilating device also includes a labyrinth comprising two chicanes giving two changes of direction, which can be seen particularly well in FIG. 6. A first or lower portion T1 of this labyrinth, the portion T1 being essentially the T-shaped air inlet mentioned above, is defined between the bottom baffle 118 of the housing and the intermediate wall 208 of the cover member. A second or intermediate portion T2 of the labyrinth is defined between the intermediate wall 208 and the central portion 110 of the intermediate baffle of the housing; while a third or upper portion T3 of the labyrinth is defined between the central portion 110 and the outer top baffle 102 of the housing, and through the space defined between the two lugs 210*a* and 210*b* of the cover member.

This third portion T3 contains the foam filter 300 if the latter is provided; in which case the filter is an obligatory point of passage immediately above the opening that provides the transition between the second and third portions of the labyrinth. This opening is defined by the edge portions 108*a*, 108*b* and the central portion 110 of the intermediate housing baffle, and by the transverse wall 204 of the cover member.

It will be noted that the passage which provides the transition between the first and second labyrinth portions T1 and T2 is bounded by the re-entrant baffle elements 114*a* and 114*b*, and by the free end of the intermediate wall 208 of the cover member, together with the inner transverse housing baffle 120.

The ventilating device is open into the interior of the housing, to the left in FIG. 6, from the region of the filter 300, through the aperture 1201 which is partly occupied by the lugs 210*a* and 210*b*.

Among the numerous advantages of this ventilating device are the following. First of all, where a foam filter is provided as described above, not only is the air filtered, but also, the filter brings about a loss of energy in the air flow which limits the ingress of humidity into the lighting, indicating or signalling device contained in the housing. Undesirable condensation effects on the front cover glass of the unit are thus minimised. In addition, the T-shaped inlet path for air into the unit also enables the entry of vapour from the engine compartment of the vehicle to be limited.

Another advantage is that this T-shaped air inlet considerably reduces the danger of water entering the lighting unit, because a high proportion of the water content of a jet impinging on the ventilating device, and entering through one of the two apertures 216*a* and 216*b*, passes straight through, to leave via the other one of these apertures without penetrating past the chicanes or transitions in the labyrinth. As to the chicanes themselves, these cause the pressure of the jet applied during high pressure jet washing of the vehicle to be broken down, with the volume of water which is not eliminated by the double air inlet arrangement being absorbed before it falls away by gravity. In this connection, tests have demonstrated good resistance to water jets under a pressure of about 4 bars.

Yet another advantage of this ventilating device is that it enables the lighting, indicating or signalling unit to "breathe", that is to say successive states of reduction or increase in pressure that occur in use, or that occur during successive periods of illumination and extinction of the unit, cause a forced air flow to be produced into the unit. This tends to carry dust with it, but this latter effect is severely limited, firstly by the presence of the double air inlet, and secondly by the possible provision of the filter 300, which reduces the air intake by giving rise to a loss of energy.

Assembly of the ventilating device by simple snap-fitting of the cover member is very simple. Mechanical strength remains satisfactory even after ageing. In addition, the fact that the foam filter, if provided, can be fitted in the cover member before assembly, facilitates assembly on a production line.

Given the effectiveness inherent in the T-shaped air inlet with a rising labyrinth, the filter 300 may of course be omitted, as has been indicated above.

The present invention is of course in no way limited to the embodiment described above and shown in the drawings: a person skilled in the art will be able to apply to it any variant or modification within the spirit of the invention.

What is claimed is:

1. A lighting unit for a motor vehicle, having a housing defining an interior and which includes a housing wall with first ventilating means carried by said housing wall, the unit having a ventilating device comprising said first ventilating means and a cover member, the cover member being fitted on said housing wall and defining second ventilating means cooperating with the first ventilating means and defining, together with the first ventilating means, a sinuous ventilation path into the interior of the housing, wherein the ventilating device comprises means defining: two air inlet apertures in transverse facing relationship with each other to define a general direction from one said air inlet aperture to the other air inlet aperture, and an inlet passage substantially transverse to said general direction, said air inlet apertures and inlet passage together defining a double air inlet constituting a lower portion of said path; a labyrinth constituting a lower portion of said path; said labyrinth extending substantially upwardly from said double air inlet; and a passage for communication between the labyrinth and the interior of the housing, the cover member having resilient lugs attaching the cover member on the housing, and said communication passage being at least partly defined between said lugs.

2. A unit according to claim 1, wherein the inlet passage constitutes a lower portion of the labyrinth.

3. A unit according to claim 1, wherein said communication passage constitutes an upper portion of the labyrinth.

4. A unit according to claim 1, wherein said first ventilating means includes an intermediate baffle and said second ventilating means includes an intermediate wall at a different height from the intermediate baffle.

5. A unit according to claim 4, wherein the intermediate wall and the intermediate baffle together define three successive portions of the labyrinth.

6. A unit according to claim 1, wherein said lugs are resilient mounting lugs defining a space between them.

7. A unit according to claim 6, wherein said first ventilating means includes a through aperture formed in the housing wall and having opposed edges, said lugs extending through said aperture in engagement with said edges, said lugs having hooking teeth cooperating with said opposed edges to secure the cover member to the housing, and the aperture being left partly open by the lugs extending through it.

8. Apparatus according to claim 6, wherein said first ventilating means includes an intermediate baffle and said second ventilating means includes an intermediate wall at a different height from the intermediate baffle, and wherein the unit further includes a foam filter and means retaining said filter between said mounting lugs.

9. A unit according to claim 8, wherein the intermediate wall and the intermediate baffle together define three successive portions of the labyrinth.

10. A unit according to claim 8, wherein the filter is positioned near the intermediate baffle.

11. A unit according to claim 8, wherein the filter is in an obligatory point of passage in the ventilation path.

* * * * *